US011009212B2

(12) United States Patent
Chen

(10) Patent No.: US 11,009,212 B2
(45) Date of Patent: May 18, 2021

(54) LAMPSHADE

(71) Applicant: Ching-Hui Chen, Guangdong (CN)

(72) Inventor: Ching-Hui Chen, Guangdong (CN)

( * ) Notice: Subject to any disclaimer, the term of this patent is extended or adjusted under 35 U.S.C. 154(b) by 0 days.

(21) Appl. No.: 17/022,108

(22) Filed: Sep. 16, 2020

(65) Prior Publication Data

US 2021/0080074 A1 Mar. 18, 2021

(51) Int. Cl.

| | |
|---|---|
| ***F21V 1/16*** | (2018.01) |
| ***F21V 1/02*** | (2006.01) |
| ***F21V 1/06*** | (2006.01) |
| ***F21V 1/12*** | (2006.01) |
| ***F21V 1/14*** | (2006.01) |

(52) U.S. Cl.

CPC ..... *F21V 1/16* (2013.01); *F21V 1/02* (2013.01); *F21V 1/06* (2013.01); *F21V 1/12* (2013.01); *F21V 1/143* (2013.01)

(58) Field of Classification Search

CPC ..... F21V 1/00–143

See application file for complete search history.

(56) References Cited

U.S. PATENT DOCUMENTS

| | | | | |
|---|---|---|---|---|
| 3,787,676 | A * | 1/1974 | Korach | F21V 1/06 362/352 |
| 4,383,291 | A * | 5/1983 | Gall | F21V 1/06 362/352 |
| 4,656,568 | A * | 4/1987 | Reed | F21V 1/06 362/352 |
| 7,267,458 | B2 * | 9/2007 | Bin | F21V 1/06 362/352 |
| 10,107,479 | B1 * | 10/2018 | Carroll | F21V 17/002 |
| 2003/0002287 | A1 * | 1/2003 | Juang | F21V 1/06 362/352 |
| 2013/0010477 | A1 * | 1/2013 | Wu | F21V 17/007 362/351 |
| 2018/0292072 | A1 * | 10/2018 | Carroll | F21V 1/143 |

* cited by examiner

*Primary Examiner* — Mariceli Santiago

(57) ABSTRACT

The present utility model discloses a lampshade with a reinforcing strip extending in the length direction along a side wall designed respectively at the bottom and/or top of the side wall and with a plurality of projecting fasteners integrated with the reinforcing strip; such design not only increases the stability of the fasteners after being decorated with the body of shade but also ensures that the reinforcing strips and the fasteners integrated with the reinforcing strips can be installed onto the bottoms and/or tops of the side walls during the lampshade production, thus avoiding the need to spend a lot of time and manpower to paste or clip the fasteners one by one onto the lampshade during the production, and further effectively improving the production efficiency and saves the production cost.

9 Claims, 5 Drawing Sheets

LAMPSHADE

BACKGROUND OF THE INVENTION

The present utility model relates to the field of lamp lighting, in particular relates to a lampshade.

The lampshades are designed surrounding the light-emitting objects such as lamps, used for light converging, strong light shading, protection against wind or rain or decoration; in the prior art, there are a plurality of connection methods for the lampshades and the support frames used for lampshade unfolding such as sticking band connection or fastener clamping connection.

For the conventional fastener clamping connection, during the lampshade production, it is necessary to clamp the fasteners one by one into the holes of a lampshade or use glue to directly paste the fasteners one by one onto a lampshade; for instance, it is necessary to use glue to paste one end of a fastener onto an in wall; the fasteners are relatively small with a limited scope of glue application, so their stability is relatively poor although they can be fixed onto the lampshade and thus they will come off the shade after a lampshade is used for a long time; furthermore, in order to clamp the fasteners to the holes on the side walls of a lampshade, it is necessary to clamp the fasteners one by one onto the holes, so such connection method takes much time and manpower, increases the production cost and leads the fasteners to coming off the holes of the side walls of a lampshade due to long-time use.

BRIEF SUMMARY OF THE INVENTION

The present utility model mainly aims to provide a lampshade and further solve the problem that the production cost is increased due to the poor stability of the small fasteners pasted or clamped onto the shade and much time and manpower needed during the production.

For realizing the aforementioned aim, the present utility model provides a lampshade, comprising a hollow shade formed by a plurality of side walls connected one by one, wherein at least two side walls are designed with a reinforcing strip extending in the length direction along every side wall designed respectively at the bottom and/or top of the side wall while a plurality of projecting fasteners are integrated with the reinforcing strip and the projecting fasteners, designed at the bottoms and/or tops of the side walls, are dismountable and connected to the support frames.

The technical solution in the present utility model is designed with a reinforcing strip extending in the length direction along a side wall designed respectively at the bottom and/or top of the side wall and with a plurality of projecting fasteners integrated with the reinforcing strip; such design not only increases the stability of the fasteners after being decorated with the body of shade but also ensures that the reinforcing strips and the fasteners integrated with the reinforcing strips can be installed onto the bottoms and/or tops of the side walls during the lampshade production, thus avoiding the need to spend a lot of time and manpower to paste or clip the fasteners one by one onto the lampshade during the production, and further effectively improving the production efficiency and saves the production cost.

DETAILED DESCRIPTION OF THE INVENTION

The technical solutions of the present utility model will be described more clearly and fully in conjunction with the accompanying drawings of the present utility model, and obviously, the described embodiments are merely a part of the embodiments of the present utility model, not all the embodiments.

Based on the embodiments of the present utility model, all the other embodiments obtained by the ordinary skilled in the art without creative labors belong to the scope claimed by the present utility model.

It should be noted that if an embodiment of the present utility model relates to directive instructions (such as upper, lower, left, right, front, rear, top, bottom, inside, outside, vertical, transverse, longitudinal, counter-clockwise, clockwise, circumferential, radial and axial), these directive instructions are merely used to explain the relative position relationship, the movement and so on among the components at certain specific posture (as shown in the accompanying drawings); if the specific posture changes, the directive instructions should be changed accordingly.

In addition, if an embodiment of the present utility model relates to the descriptions such as "first" and "second", these descriptions are merely used for description and should not be understood to indicate or imply their relative importance or implicitly indicate the number of the corresponding technical features.

This shows that the features limited with "first" and "second" can explicitly or implicitly include one such feature at least.

Moreover, the technical solutions among the embodiments can be in combination with each other; however, such combination must be on the premise that those skilled in the art can realize the related technical solutions; when the technical solutions are inconsistent or cannot be realized, such combination of technical solutions should be deemed to be inexistent and not in the scope claimed by the present utility model.

The present utility model provides a lampshade.

Figure 1:
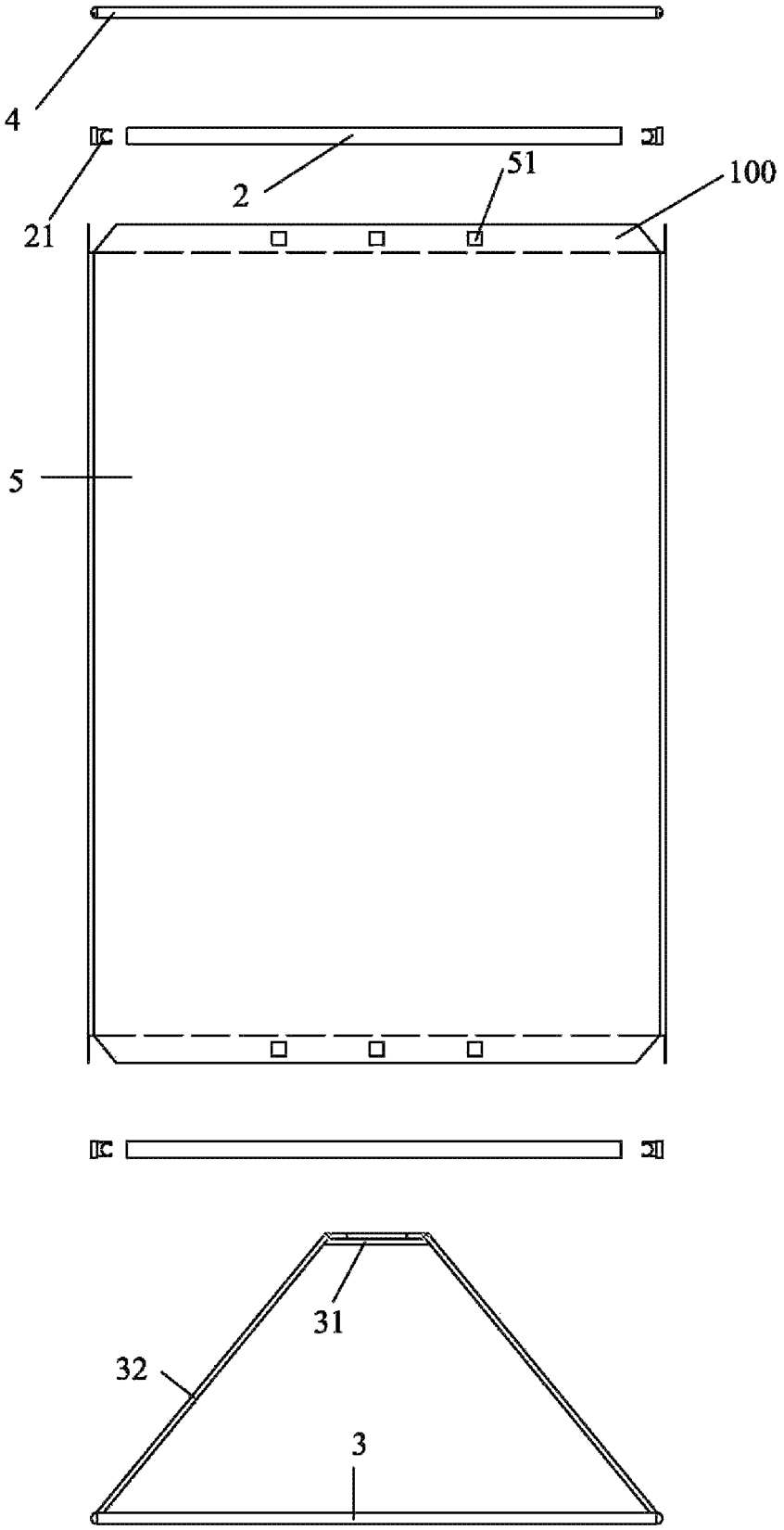
FIG. 1 is a schematic exploded view from one angle of the present utility model.
Figure 2:
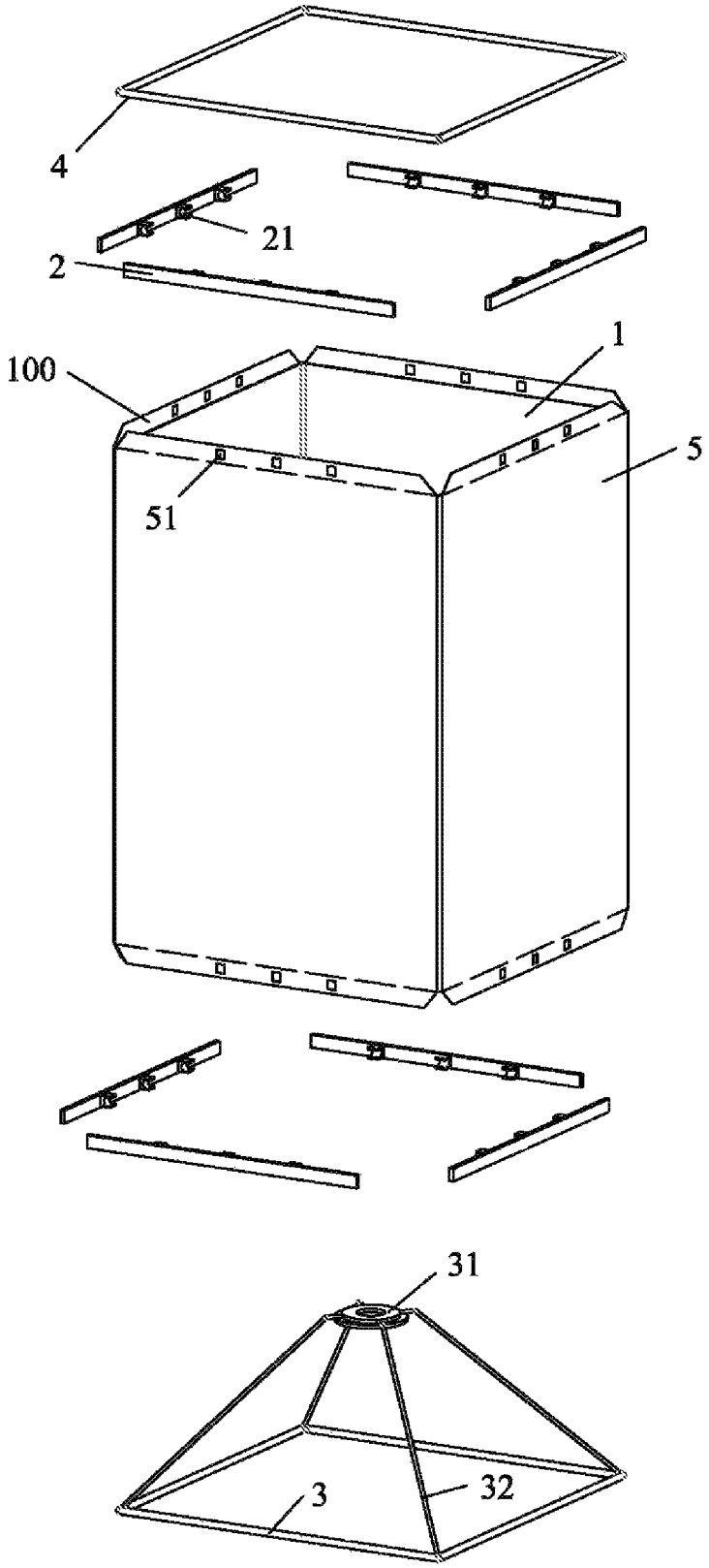
FIG. 2 is a schematic exploded view from another angle of the present utility model.
Figure 3:
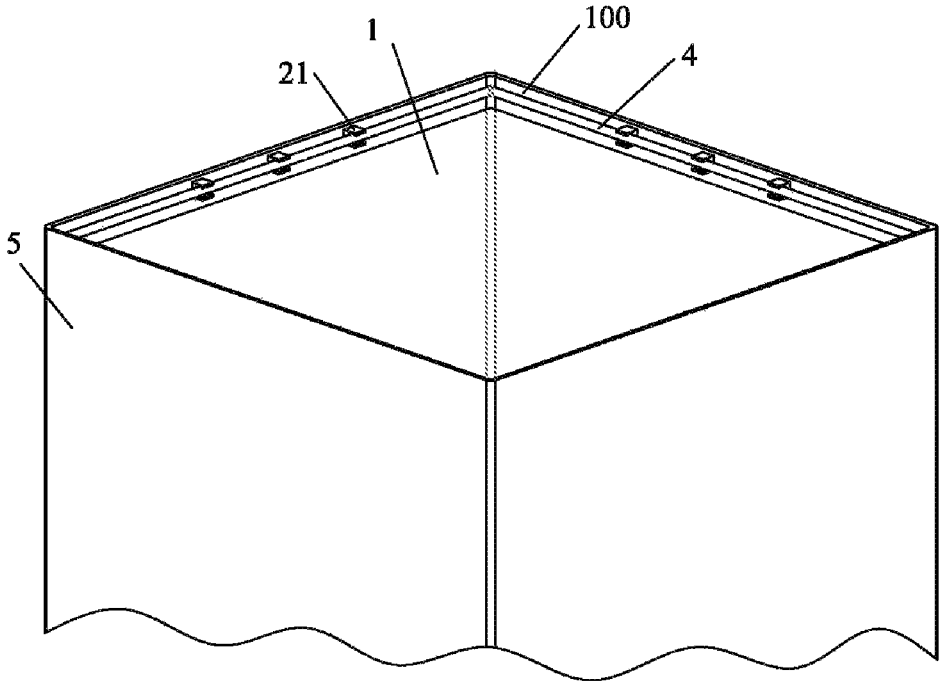
FIG. 3 is a schematic vertical view from one angle of the present utility model.
Figure 4:
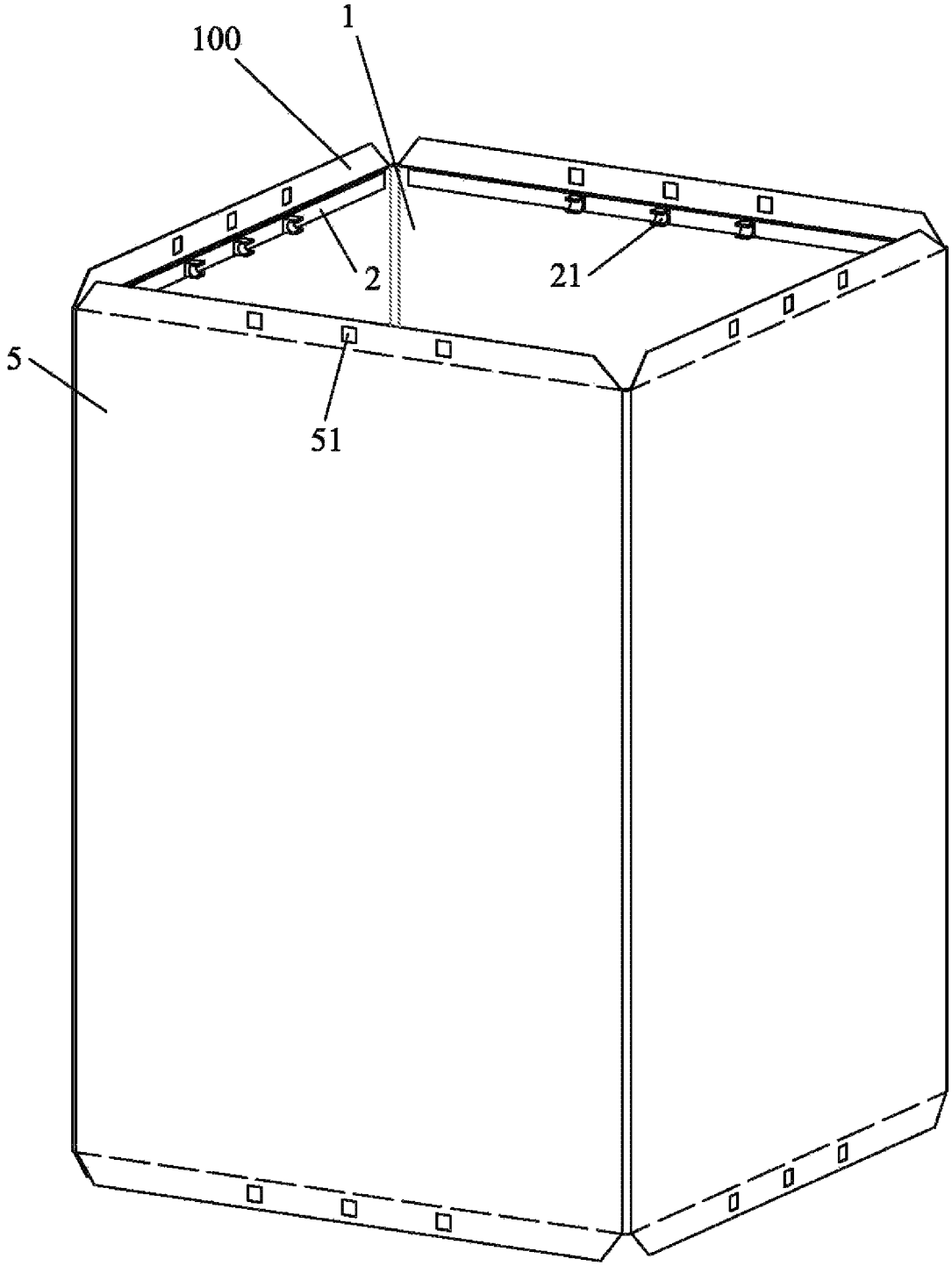
FIG. 4 is a vertical view of the reinforcing strips after being pasted onto the hollow shade.

In the embodiments of the present utility model, as shown in FIGS. 1~3, a lampshade comprises a hollow shade (1) formed by a plurality of side walls connected one by one, wherein at least two side walls are designed with a reinforcing strip (2) extending in the length direction along every side wall designed respectively at the bottom and/or top of the corresponding side wall while a plurality of projecting fasteners (21) are integrated with the reinforcing strip (2), and the projecting fasteners (21) designed at the bottoms and/or tops of the side walls are dismountable and connected to the support frames (3,4).

It should be noted that in this embodiment, in order to better fix the support frames (3 & 4), it is preferred to design the reinforcing strips (2) extending in the length direction along all the side walls respectively at the bottoms and/or tops of the side walls, and meanwhile, it is allowed to design the number of the fasteners as per the lengths of the reinforcing strips (2); generally speaking, the longer the reinforcing strips (2) are, the more the fasteners (21) are while the shorter the reinforcing strips (2), the less the fasteners (21); in this embodiment, the number of the fasteners (21) integrated with a reinforcing strip (2) is 3.

It can be understood that the side walls can be connected end to end and also can be spliced while the connection or splicing can use the waterproof glue pasting method or the wire gap junction method.

Concretely, the shade (1) can be square or rectangle, pentagonal or hexagonal; in this embodiment, the shade (1) is square.

Likewise, the number of edges of the support frame (3 or 4) is equal to the number of the side walls [or the number of the edges of the shade (1)]; therefore, in his embodiment, the support frame (3 or 4) is square like the shade (1).

Concretely, the reinforcing strips and the fasteners are made from rubber, plastic or metal materials and integrated with each other.

In this embodiment, the plastic material is preferred.

Furthermore, the lampshade also comprises woven fabric (5) which is fixed closely onto the outside surfaces of the side walls.

In this embodiment, the woven fabric (5) is pasted and fixed on the outside surfaces of the side walls via waterproof glue which is highly flexibly, waterproof and damp[-roof with strong adhesive property and strong resistance to cracking; in daily use, it is necessary to remove, clean and dry the shade (1) in the sun at intervals; the ordinary glue will gradually lose its adhesive property and crack at the pasting positions after being cleaned and dried in the sun repeatedly while the shade (1) pasted with the waterproof glue still can maintain the adhesive property of the waterproof glue after being cleaned and dried in the sun repeatedly and thus prolong the service life of the lampshade.

The upper and lower ends of every piece of woven fabric (5) have an extension (100) extending the corresponding side wall respectively, wherein after being folded, the extension (100) is connected to the internal surface of the corresponding side via the wire gap junction method or the waterproof glue pasting method and wrap the corresponding reinforcing strip (2) so that the reinforcing strip (2) is located between the internal surface of the corresponding side wall of the shade (1) and the extension (100) [the reinforcing strip (2) also can be pasted onto the side wall of the shade (1) via glue in order to fix the reinforcing strip (2) more securely onto the lampshade]; the reinforcing strip (2) wrapped and fixed onto the shade (1) also can prevent the upper and lower ends of the shade (1) from deformation [in other words, the reinforcing strip (2) can support the upper and lower-end surfaces of the shade (1)].

Concretely, the positions of the woven fabric (5) corresponding to the fasteners (21) are designed with the holes (51) for the fasteners (21) to pass through while the number of the holes (51) is equal to the number of the fasteners (21) which pass through the holes (51) and thus can cooperate with the support frames (3,4) via the clamping method.

At least one support frame (3 or 4) is designed with a lamp-holder mounting port (31) inside while the lamp-holder mounting port (31) is connected to the support frame (3 or 4) via connecting pieces (32).

It should be noted that the lamp-holder mounting port (31) is used to cooperate with the lamp holder on the lamp and thus can make the whole lampshade be fixed onto the lamp holder of the lamp.

Concretely, the number of the connecting pieces (32) is equal to the number of the edges of the support frame (3, 4).

In this embodiment, the support frame (3 or 4) is square, so the number of the connecting pieces (32) is 4; one end of every connecting piece (32) is fixed into one inner corner of the support frame (3) and the end of every connecting piece (32) away from the support frame (3) is fixed onto the lamp-holder mounting port (31).

Concretely, the edges of the extensions (100) are connected to the internal surfaces of the side walls via waterproof glue or wire gap junction.

At the time of connection, it is allowed to first fold the extension (100) towards the shade (1) to fully wrap the reinforcing strip (2) and then fix the extension wrapping the reinforcing strip (2) onto the internal surface of the shade (1).

Figure 5:
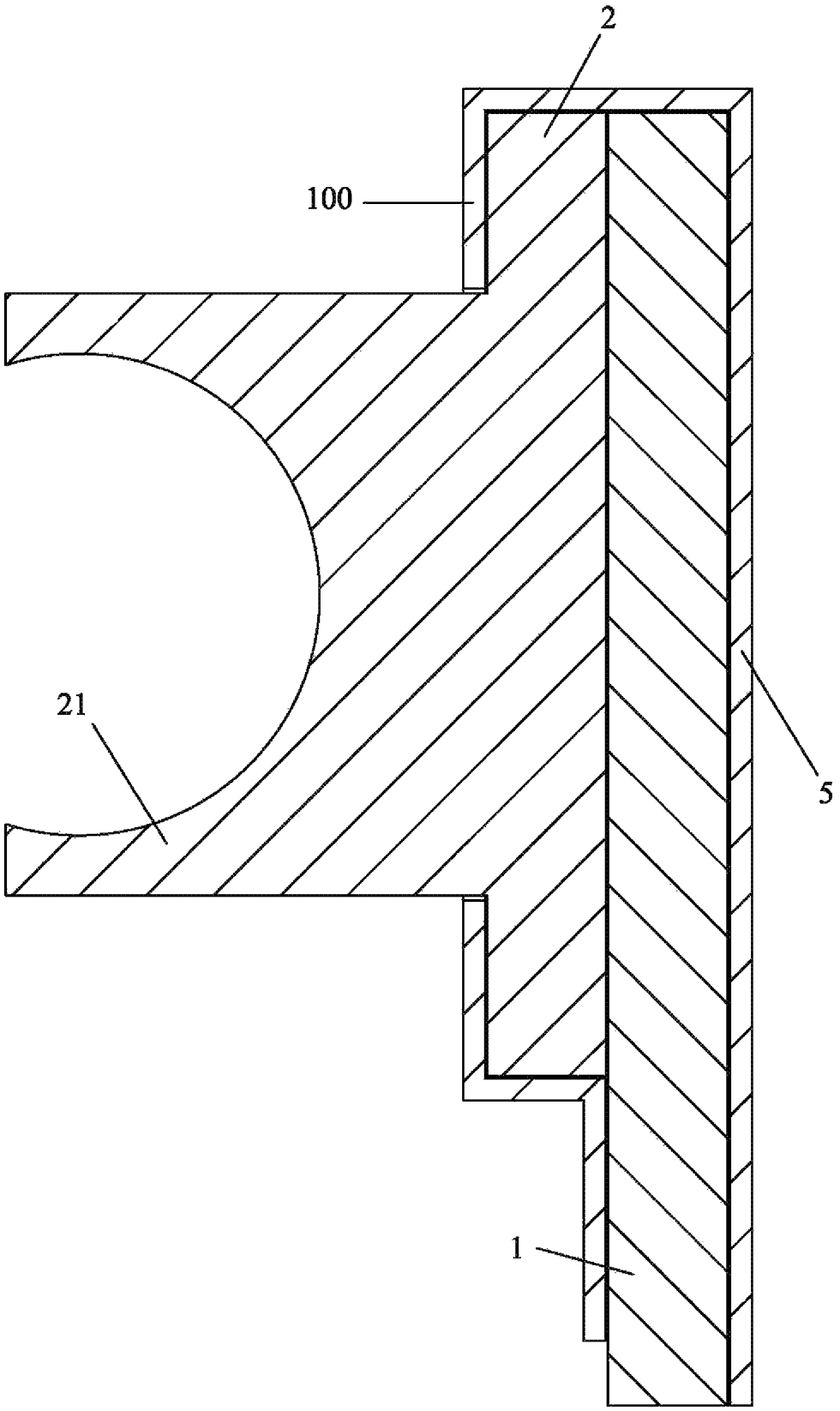
FIG. 5 is a cutaway view of the present utility model.

Also as shown n FIG. 3) and FIG. 5), it is allowed to first fix the reinforcing strip (2) onto the shade (1), and then fold the extension (100) towards the internal surface of the shade (1) to cover the reinforcing strip (2) fixed onto the shade (1); if the extension (100) has a remaining edge after covering the reinforcing strip (2), it is allowed to fix the remaining edge onto the internal surface of the shade (1) via the waterproof glue pasting method or the wire gap junction method.

The realization of dual fixing can fix the whole reinforcing strip (2) securely onto the lampshade; the fastener (21) and the reinforcing strip (2) are integrated together, in other words, the fastener (21) is fixed securely onto the lampshade and thus will not come off easily and thus prolong the service life of product.

The described embodiments are merely the preferred embodiments of the present utility model, not to limit the patent scope of the present utility model; with the conception of the present utility model, any equivalent structure transformation using the Specifications and the accompanying drawings of the present utility model or direct/indirect applications to other related technical fields should be included in the scope claimed by the present utility model.

What is claimed is:

1. A lampshade, comprising a hollow shade (1) formed by a plurality of side walls connected one by one, wherein at least two side walls are designed with a reinforcing strip (2) extending in the length direction along every side wall designed respectively at the bottom and/or top of the side wall while a plurality of projecting fasteners (21) are integrated with the reinforcing strip (2) and the projecting fasteners (21), designed at the bottoms and/or tops of the side walls, are dismountable and connected to support frames (3,4); the lampshade also comprises woven fabric (5) which is fixed closely onto an outside surface of the side walls.

2. The lampshade in accordance with claim 1, wherein the shade (1) is a square or rectangle.

3. The lampshade in accordance with claim 1, wherein the number of the edges of the support frames (3,4) is equal to the number of the side walls.

4. The lampshade in accordance with claim 1, wherein the reinforcing strip (2) and the fasteners (21) are made from rubber, plastic or metal materials and integrated with each other.

5. The lampshade in accordance with claim 1, wherein the upper and lower ends of every piece of woven fabric (5) have an extension (100) extending the corresponding side wall respectively while the extension (100) is trapezoid, and after it is folded, it is connected to the internal surface of the corresponding side and wrap the corresponding reinforcing strip (2) so that the reinforcing strip (2) is located between the extension (100) and the side wall.

6. The lampshade in accordance with claim 1, wherein the positions of the woven fabric (5) corresponding to the fasteners (21) are designed with holes (51) for the fasteners (21) to pass through.

7. The lampshade in accordance with claim 1, wherein at least one support frame (3 or 4) is designed with a lamp-holder mounting port (31) inside while the lamp-holder mounting port (31) is connected to the support frame (3) via connecting pieces (32), one end of each connecting piece (32) is fixed onto the support frame (3) and the other end is fixed onto the lamp-holder mounting port (31).

8. The lampshade in accordance with claim 7, wherein the number of the connecting pieces (32) is equal to the number of the edges of the support frame (3, 4).

9. The lampshade in accordance with claim 5, wherein the edges of the extensions (100) are connected to the internal surfaces of the side walls via the waterproof glue pasting method or the wire gap junction method.

* * * * *